US009777545B2

(12) United States Patent
Ludwig

(10) Patent No.: US 9,777,545 B2
(45) Date of Patent: Oct. 3, 2017

(54) WELL TRACTOR

(75) Inventor: Wesley Neil Ludwig, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 217 days.

(21) Appl. No.: 14/406,889

(22) PCT Filed: Jun. 14, 2012

(86) PCT No.: PCT/US2012/042371

§ 371 (c)(1),
(2), (4) Date: Dec. 10, 2014

(87) PCT Pub. No.: WO2013/187898

PCT Pub. Date: Dec. 19, 2013

(65) Prior Publication Data

US 2015/0167416 A1 Jun. 18, 2015

(51) Int. Cl.

| | |
|---|---|
| ***E21B 23/14*** | (2006.01) |
| ***E21B 4/00*** | (2006.01) |
| ***E21B 4/18*** | (2006.01) |
| *E21B 23/00* | (2006.01) |

(52) U.S. Cl.

CPC ..... *E21B 23/14* (2013.01); *E21B 4/006* (2013.01); *E21B 4/18* (2013.01); *E21B 2023/008* (2013.01)

(58) Field of Classification Search

CPC ..... E21B 23/14; E21B 2023/008
See application file for complete search history.

(56) References Cited

U.S. PATENT DOCUMENTS

| | | | | |
|---|---|---|---|---|
| 4,137,013 | A * | 1/1979 | Woodruff | F04B 1/295 417/222.1 |
| 5,794,703 | A | 8/1998 | Newman et al. | |
| 6,273,189 | B1 | 8/2001 | Gissler et al. | |
| 7,143,843 | B2 | 12/2006 | Doering et al. | |
| 2004/0262044 | A1 * | 12/2004 | Schaaf | E21B 3/02 175/61 |

(Continued)

FOREIGN PATENT DOCUMENTS

| | | | |
|---|---|---|---|
| DK | WO 9318277 A1 * | 9/1993 | E21B 23/00 |
| WO | 8601751 | 3/1986 | |

(Continued)

OTHER PUBLICATIONS

Authorized Officer Choi Soo Jung, PCT International Search Report and Written Opinion of the International Searching Authority, PCT/US2012/042371, Feb. 20, 2013, 12 pages.

*Primary Examiner* — George Gray
(74) *Attorney, Agent, or Firm* — Alan Bryson; Parker Justiss, P.C.

(57) ABSTRACT

A method for operating a well tractor is presented. The method involves running a well tractor coupled to a wireline into a wellbore and supplying an amount of electric power to the well tractor to operate the well tractor at a first speed to urge the wireline through the wellbore at a first force. A variable gear ratio transmission of the well tractor is adjusted and an amount of electric power is supplied to the well tractor to operate the well tractor at a second speed different than the first speed to urge the wireline through the wellbore at a second force different than the first force based on adjusting the variable gear ratio transmission.

19 Claims, 6 Drawing Sheets

(56) References Cited

U.S. PATENT DOCUMENTS

| | | | | |
|---|---|---|---|---|
| 2005/0034874 | A1 | 2/2005 | Guerrero | |
| 2006/0151212 | A1* | 7/2006 | Doering | E21B 4/18 175/24 |
| 2007/0000693 | A1* | 1/2007 | Bloom | E21B 4/18 175/51 |
| 2008/0308318 | A1 | 12/2008 | Moore | |
| 2009/0044951 | A1* | 2/2009 | Milkovisch | E21B 49/10 166/369 |
| 2010/0187009 | A1 | 7/2010 | Siher et al. | |
| 2012/0083944 | A1* | 4/2012 | Heieie | E21B 7/046 701/2 |

FOREIGN PATENT DOCUMENTS

| | | |
|---|---|---|
| WO | WO 2008/091157 | 7/2008 |
| WO | WO 2008/100362 | 8/2008 |
| WO | WO 2008/128542 | 10/2008 |
| WO | WO 2008/128543 | 10/2008 |
| WO | WO 2008/131771 | 11/2008 |
| WO | WO 2008/131772 | 11/2008 |

* cited by examiner

WELL TRACTOR

TECHNICAL BACKGROUND

This disclosure relates to a well tractor.

BACKGROUND

Downhole propulsion machines, often referred to as "tractors," have been used to facilitate the conveyance of wireline assemblies and coiled tubing strings into a wellbore. Such tractors are designed to engage the inner walls of the casing, string or open hole, as the case may be, to propel the tractor and any portions of pipe or tubing or wireline tools connected thereto. A well, or downhole, tractor (e.g., a downhole wireline tractor) receives electrical power from a terranean surface via a wireline. The power is routed to an electric motor. Typically, the electric motor is connected to a system of gears to directly drive traction wheels, or the electric motor drives a hydraulic pump that in turn drives one or more hydraulic motors to drive the traction wheels. In any event, such drive assemblies are typically fixed ratio systems such that a drive speed is directly proportional to the speed (e.g., RPM) of the electric motor. In such systems, a reduction in power to the electric motor is necessary for a reduction in speed of the downhole tractor. Further, the fixed ratio system usually is designed for the "worst case" force required of the tractor, i.e., an amount of force necessary to pull the wireline through the wellbore at a distal end (e.g., relative to the wellbore opening at the terranean surface) of the wellbore, especially an articulated, horizontal, or otherwise directional wellbore. As such, during operation of the tractor at "off design" conditions (e.g., at points within the wellbore between the surface and the distal end), optimal operation efficiency and/or speed may not be obtained.

DETAILED DESCRIPTION

Figure 1:
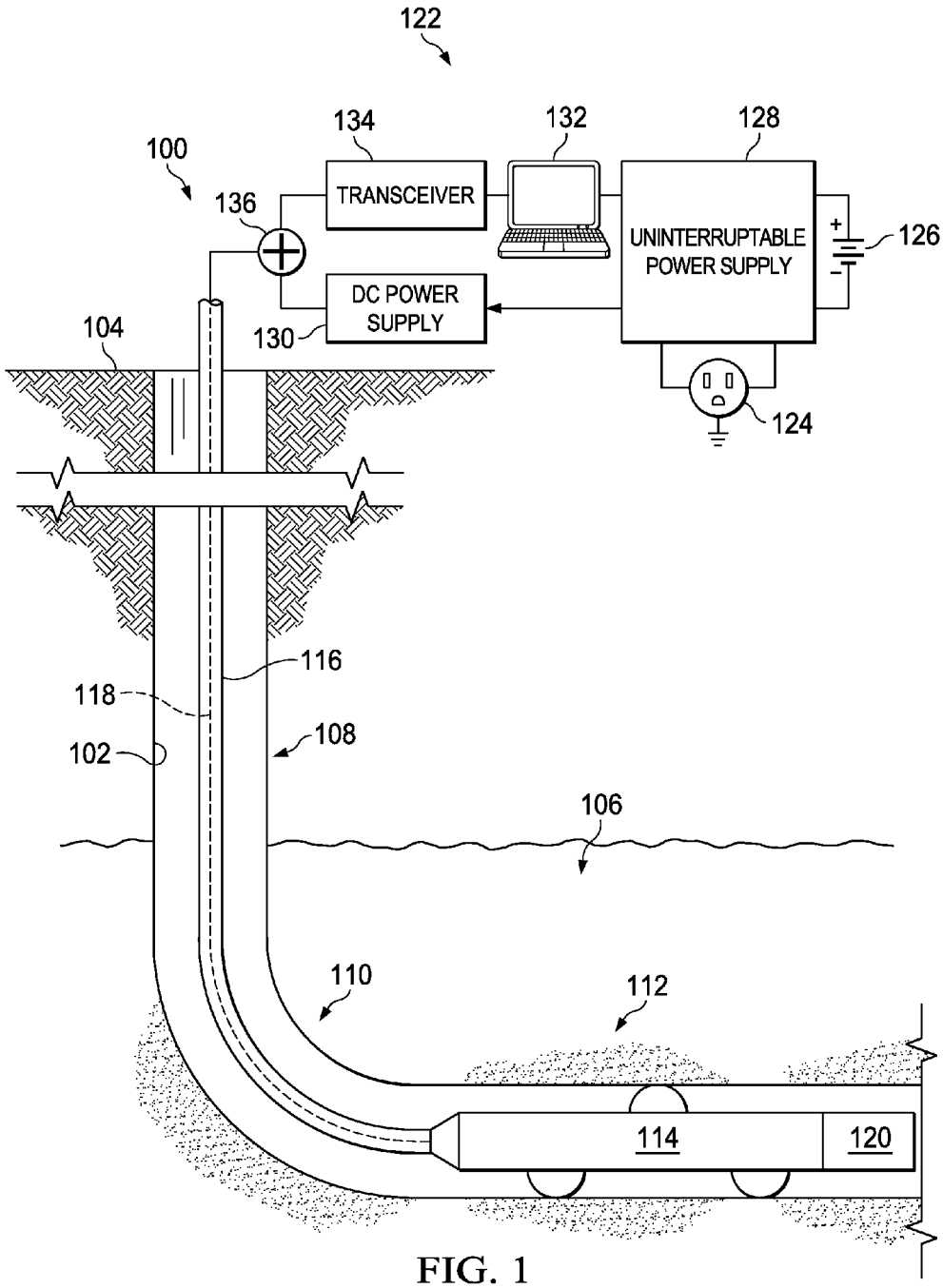
FIG. 1 illustrates an example downhole system including an example embodiment of a variable ratio downhole tractor.

The present disclosure describes implementations of a well tractor. In an example implementation, a well tractor includes a housing; a roller coupled to the housing; an electric motor coupled to the roller; and a variable ratio transmission coupled between the motor and the roller, the variable ratio transmission operable to drive the roller.

In a first aspect combinable with the example implementation, the electric motor comprises an electric DC motor.

In a second aspect combinable with any of the previous aspects, the electric motor is operable to receive power from a wireline conductor.

In a third aspect combinable with any of the previous aspects, the wireline conductor comprises a single conductor wireline.

In a fourth aspect combinable with any of the previous aspects, the variable ratio transmission is operable to drive the roller at a plurality of rotational speeds at a substantially constant motor speed.

In a fifth aspect combinable with any of the previous aspects, the variable ratio transmission comprises a hydraulic pump coupled to the electric motor through a shaft, the hydraulic pump comprising a working fluid; and a hydraulic motor fluidly coupled to the hydraulic pump to receive the working fluid circulated between the hydraulic pump and the hydraulic motor, the hydraulic motor coupled to the roller.

A sixth aspect combinable with any of the previous aspects further includes a supply conduit and a return conduit, each conduit fluidly coupling the hydraulic pump to the hydraulic motor and operable to contain the working fluid circulated between the hydraulic pump and the hydraulic motor.

In a seventh aspect combinable with any of the previous aspects, each rotational speed of the plurality of rotational speeds has an associated flow rate of the working fluid through the hydraulic motor.

In an eighth aspect combinable with any of the previous aspects, the hydraulic pump comprises a variable displacement pump having a first fluid output per revolution at a first rotational speed of the roller of the plurality of rotational speeds and a second fluid output per revolution at a second rotational speed of the roller of the plurality of rotational speeds.

In a ninth aspect combinable with any of the previous aspects, the first fluid output per revolution defines a first force at the first rotational speed of the roller, and the second fluid output per revolution defines a second force.

In a tenth aspect combinable with any of the previous aspects, the first force is based at least on a drag on the tractor from the wireline when the tractor is at or near a maximum distance of the tractor from a terranean surface in a wellbore.

In an eleventh aspect combinable with any of the previous aspects, the housing comprises an uphole end and a downhole end adapted to receive a downhole tool.

In a twelfth aspect combinable with any of the previous aspects, at least one of the plurality of rotational speeds is based on a type of the downhole tool.

In a thirteenth aspect combinable with any of the previous aspects, the downhole tool comprises one of a perforating tool or a measurement tool.

In a fourteenth aspect combinable with any of the previous aspects, the variable ratio transmission comprises a hydraulic pump coupled to the electric motor through a first shaft, the hydraulic pump comprising a working fluid; a hydraulic motor fluidly coupled to the hydraulic pump to receive the working fluid circulated between the hydraulic pump and the hydraulic motor; and a second rotatable shaft coupled between the hydraulic motor and the roller.

A fifteenth aspect combinable with any of the previous aspects further includes a supply conduit and a return conduit fluidly coupling the hydraulic pump to the hydraulic motor, and operable to contain the working fluid circulated between the hydraulic pump and the hydraulic motor.

In a sixteenth aspect combinable with any of the previous aspects, each rotational speed of the roller of the plurality of rotational speeds has an associated flow rate of the working fluid through the hydraulic motor.

In a seventeenth aspect combinable with any of the previous aspects, the hydraulic pump comprises a variable displacement pump having a first fluid output per revolution at a first rotational speed of the roller of the plurality of rotational speeds and a second fluid output per revolution at a second rotational speed of the roller of the plurality of rotational speeds.

In an eighteenth aspect combinable with any of the previous aspects, the first fluid output per revolution defines a first force at the first rotational speed of the roller, and the second fluid output per revolution defines a second force at the second rotational speed of the roller.

In a nineteenth aspect combinable with any of the previous aspects, the first force is based at least on a drag on the tractor from the wireline when the tractor is at or near a maximum distance of the tractor from a terranean surface in a wellbore.

In a twentieth aspect combinable with any of the previous aspects, the housing comprises an uphole end and a downhole end adapted to receive a downhole tool.

In a twenty-first aspect combinable with any of the previous aspects, at least one of the plurality of rotational speeds is based on a type of the downhole tool.

In a twenty-second aspect combinable with any of the previous aspects, the downhole tool comprises one of a perforating tool or a measurement tool.

In a twenty-third aspect combinable with any of the previous aspects, the roller comprises one of a wheel or a track.

In another example implementation, a method includes running a well tractor coupled to a wireline into a wellbore; supplying an amount of electric power to the well tractor to operate the well tractor at a first speed to urge the wireline through the wellbore at a first force; adjusting a variable ratio transmission of the well tractor; and supplying the amount of electric power to the well tractor to operate the well tractor at a second speed different than the first speed to urge the wireline through the wellbore at a second force different than the first force based on adjusting the variable ratio transmission.

In a first aspect combinable with the example implementation, adjusting a variable ratio transmission of the well tractor comprises adjusting a variable ratio transmission of the well tractor based on an amount of drag on the tractor.

A second aspect combinable with any of the previous aspects further includes further adjusting the variable ratio transmission of the well tractor based on the amount of drag exerted on the well tractor; and supplying the amount of electric power to the well tractor to operate the well tractor at a third speed less than the first and second speeds to urge the wireline through the wellbore at a third force greater than the first and second forces based on further adjusting the variable ratio transmission.

A third aspect combinable with any of the previous aspects further includes further adjusting the variable ratio transmission of the well tractor based on the amount of drag exerted on the well tractor; and supplying the amount of electric power to the well tractor to operate the well tractor at a third speed greater than the first and second speeds to urge the wireline through the wellbore at a third force less than the first and second forces based on further adjusting the variable ratio transmission.

In a fourth aspect combinable with any of the previous aspects, adjusting a variable ratio transmission of the well tractor comprises adjusting an output of a variable displacement hydraulic pump coupled to an electric motor that receives the predetermined amount of power; and based on the output adjustment of the variable displacement hydraulic pump, adjusting at least one of a fluid pressure or a flow rate of a working fluid circulated between the variable displacement hydraulic pump and a hydraulic motor coupled to a roller of the well tractor.

In a fifth aspect combinable with any of the previous aspects, adjusting an output of a variable displacement hydraulic pump comprises adjusting a stroke length of a piston of the variable displacement hydraulic pump.

In a sixth aspect combinable with any of the previous aspects, adjusting a stroke length of a piston of the variable displacement hydraulic pump comprises adjusting a swash plate of the variable displacement hydraulic pump.

In a seventh aspect combinable with any of the previous aspects, supplying an amount of electric power to the well tractor comprises supplying an amount of electric power to an electric motor of the well tractor that is coupled to the variable ratio transmission through a shaft to drive the shaft at a substantially constant rotational speed.

In an eighth aspect combinable with any of the previous aspects, adjusting a variable ratio transmission of the well tractor comprises adjusting an output of a variable displacement hydraulic pump coupled to an electric motor that receives the amount of power; based on the output adjustment of the variable displacement hydraulic pump, adjusting at least one of a fluid pressure or a flow rate of a working fluid circulated between the variable displacement hydraulic pump and a hydraulic motor; and adjusting a rotational speed of a shaft coupled between the hydraulic motor and a roller of the well tractor based on the adjustment of the fluid pressure or flow rate of the working fluid.

In a ninth aspect combinable with any of the previous aspects, adjusting an output of a variable displacement hydraulic pump comprises adjusting a stroke length of a piston of the variable displacement hydraulic pump.

In a tenth aspect combinable with any of the previous aspects, adjusting a stroke length of a piston of the variable displacement hydraulic pump comprises adjusting a swash plate of the variable displacement hydraulic pump.

An eleventh aspect combinable with any of the previous aspects further includes driving the roller at a first rotational speed based on the rotational speed of the shaft to operate the well tractor at the second speed.

In a twelfth aspect combinable with any of the previous aspects, supplying an amount of electric power to the well tractor comprises supplying an amount of electric power to an electric motor of the well tractor that is coupled to the variable ratio transmission through a main shaft to drive the main shaft at a substantially constant rotational speed.

A thirteenth aspect combinable with any of the previous aspects further includes detecting the amount of drag exerted on the well tractor; detecting a change to the amount of drag exerted on the well tractor; and further adjusting the variable ratio transmission of the well tractor based on the detected change to the amount of drag exerted on the well tractor.

In another example implementation, a method includes receiving an amount of electrical power at an electric motor of a well tractor; outputting a first amount of force by the well tractor; adjusting a ratio of a variable ratio transmission of the well tractor; receiving the amount of electrical power at the electric motor of the well tractor; and outputting a second amount of force by the well tractor that is different than the first amount of force.

A first aspect combinable with the example implementation further includes receiving a first amount of drag on the well tractor; adjusting the ratio of the variable ratio transmission of the well tractor based on the first amount of drag; receiving a second amount of drag on the well tractor that is different than the first amount of drag; and further adjusting the ratio of the variable ratio transmission of the well tractor based on the second amount of drag.

In a second aspect combinable with any of the previous aspects, adjusting a ratio of a variable ratio transmission of the well tractor comprises adjusting an output of a variable displacement hydraulic pump of the variable ratio transmission.

In a third aspect combinable with any of the previous aspects, adjusting an output of a variable displacement hydraulic pump of the variable ratio transmission comprises adjusting a fluid flow rate or pressure of a working fluid circulated between the variable displacement hydraulic pump and a hydraulic motor.

A fourth aspect combinable with any of the previous aspects further includes adjusting a speed of a roller of the well tractor coupled to the hydraulic motor based on the adjusted flow rate or pressure of the working fluid.

Various embodiments of a variable ratio downhole tractor according to the present disclosure may include one or more of the following features. For example, the downhole tractor may allow tractor operation at high speeds and low force or slow speeds and high force without requiring tractor configuration changes at the surface. The downhole tractor may maximize system efficiency (e.g., available electric power in vs. mechanical power out) of the tractor as compared to a fixed ratio tractor even though individual components in the variable ratio tractor may introduce power losses. The variable ratio tractor may have better efficiency as compared to a fixed ratio tractor for almost all points over a force vs. speed curve. As another example, the variable ratio tractor may allow for a gear ratio to be changed downhole to match a current condition of the wellbore (e.g., drag on the tractor due to friction, wireline weight, and otherwise). Further, the variable ratio tractor may accomplish a downhole operation (e.g., pulling a wireline to a particular point in the wellbore) faster than a fixed ratio tractor.

Various embodiments of a variable ratio downhole tractor according to the present disclosure may also include one or more of the following features. With a variable ratio tractor, the ratio can be changed to allow the electric motor to operate at or near full speed across a wide range of tractor speeds. This may allow maximum power to be transmitted to the variable ratio tractor for a variety of tractor speeds as compared to a fixed ratio tractor, in which maximum power can only be transferred to the tractor at maximum speed. For instance, in some embodiments, a reduction of speed of a fixed ratio tractor requires a reduction in voltage supplied to the electric motor of the tractor. The variable ratio tractor may provide for faster operation at low force (e.g., at a beginning of a tractor run in a horizontal wellbore) while also allowing for a high force at low speed when required (e.g., at or near an end of the run in the horizontal wellbore). The faster operation allows the run to be completed in less time, lowering the cost of performing the job since, in a long horizontal section force will generally build from near zero when tractoring starts to a maximum when the tractor is dragging the longest length of wireline. As another example, the variable ratio tractor may avoid not being able to complete a job because the maximum tractoring force of a fixed ratio tractor was reached due to the fixed ratio tractor being configured to run in a higher speed, lower force configuration. Other features, advantages, and other benefits will be apparent from the drawings and descriptions thereof.

FIG. 1 illustrates an example downhole system 100 including an example embodiment of a variable ratio downhole tractor 114 ("variable ratio tractor"). In some embodiments, the variable ratio tractor 114 may be operable at a variety of speed/force combinations during a tractoring run into and through the illustrated wellbore 102. The particular speed/force combination may depend on, for instance, an amount of a counter force (e.g., friction, wireline or coiled tubing weight, obstructions, and otherwise) acting on the variable ratio tractor 114 during the tractoring run. For instance, the variable ratio tractor 114 may include a variable speed transmission that effectively allows adjustment of a gear ratio during operation of the variable ratio tractor 114 in the wellbore 102 to best fit a speed/force of the variable ratio tractor 114 with a current set of downhole conditions. In some embodiments, the variable speed transmission (or variable ratio transmission) may be continuously variable. Alternatively, the variable speed transmission may include multiple fixed gear ratios, so as to be operable to drive the tractor 114 at multiple speeds in the wellbore 102.

The illustrated system 100 in which the variable ratio tractor 114 may operate includes the variable ratio tractor 114 coupled to a length of wireline 116 and positioned in a wellbore 102. The illustrated wellbore 102 is a deviated wellbore that is formed to extend from a terranean surface 104 to a subterranean zone 106 (e.g., a hydrocarbon bearing geologic formation) and includes a vertical portion 108, a radius portion 110, and a horizontal portion 112. Although portions 108 and 112 are referred to as "vertical" and "horizontal," respectively, it should be appreciated that such wellbore portions may not be exactly vertical or horizontal, but instead may be substantially vertical or horizontal to account for drilling operations. Further, the wellbore 102 may be a cased well, a working string or an open hole, and is of such length that it is shown broken.

The illustrated system 100 includes a wireline 116 extending from the terranean surface 104 to the variable ratio tractor 114. Electrical power and control signals to and from the variable ratio tractor 114 are transmitted via the wireline 116, which includes, for example, a single-strand or multi-strand conductor 118 that is run through the wireline 116 downhole to the variable ratio tractor 114. In some embodiments, the wireline 116 may be an electrical cable to lower tools (e.g., the variable ratio tractor 114 and/or other downhole tool) into the wellbore 102 and to facilitate the transmission of power and data. The wireline 116, in some embodiments, may be a conductor for electric logging and cables incorporating electrical conductors.

The variable ratio tractor 114 includes a tubular housing that may be subdivided into various subs, at least one of which includes one or more wheels and another that is a coupling sub to connect to the wireline 116. Although the term "wheel" is used herein, the present disclosure contemplates that other rolling members, such as tracks, roller bearings, or otherwise, may also be employed in lieu of or in addition to any illustrated wheels. Although three wheels are illustrated in FIG. 1, the variable ratio tractor 114 may include more wheels, as appropriate. One or more wheels may be powered wheel assemblies for propelling the variable ratio tractor 114 through the wellbore 102 in order to run the wireline 116 into the wellbore 102. Other wheels or wheel assemblies of the variable ratio tractor 114 may not be powered but instead be freely rotatable in contact with the wellbore 102 (or casing as appropriate) during operation of the variable ratio tractor 114.

Electrical and hydraulic power subs may also be included in the variable ratio tractor 114 and may deliver electrical and hydraulic power to various portions of the tractor 114. A lower coupling sub of the variable ratio tractor 114, as illustrated, is coupled to a downhole tool 120, which may be, for example, a shifting tool, a logging tool, an explosive tool (e.g., a perforating gun or otherwise), a packer, or other type of downhole tool, or other payload.

The illustrated wireline 118 is connected to a surface/control system 122 that includes an AC power supply 124 and a backup battery supply 126 connected to an uninterruptable power supply 128. The output of the uninterruptable power supply 128 is connected to a DC power supply 130 which converts the AC current to DC. A controller 132 is provided to perform a variety of control and data acquisition functions, such as controlling the power supply to the variable ratio tractor 114, receiving and determining forces acting on the variable ratio tractor 114 sensed by one or more sensors in the variable ratio tractor 114, and retrieving and displaying data obtained by various sensors in the variable ratio tractor 114. The controller 132 is connected to the uninterruptable power supply 128 and a transceiver 134.

As illustrated, the outputs of both the transceiver 134 and the DC power supply 130 are connected to the wireline 118 via a summing node 136. Accordingly, the transceiver 134 is designed to feed signals from the controller 132 into the wireline 118 and vice versa, that is, receive signals transmitted from the variable ratio tractor 114. The simultaneous transmission of DC power and electronic control signals between the controller 132 and the variable ratio tractor 114 is possible through use of an appropriate data/power transmission protocol providing for simultaneous transmission of power and data through a single conductor. Although power supply 130 is illustrated as a DC power supply, in alternative embodiments, an AC power supply may be used as the power supply 130.

The illustrated controller 132, in some embodiments, may be a server that stores and/or executes one or more software applications. At a high level, the server is an electronic computing device operable to receive, transmit, process, store, or manage data and information associated with the system 100. As used in the present disclosure, the term "computer" or "computing device" is intended to encompass any suitable processing device. For example, although FIG. 1 illustrates a single controller 132, system 100 can be implemented using two or more servers, as well as computers other than servers, including a server pool. Indeed, the controller 132 may be any computer or processing device such as, for example, a blade server, general-purpose personal computer (PC), Macintosh, workstation, UNIX-based workstation, or any other suitable device. In other words, the present disclosure contemplates computers other than general purpose computers, as well as computers without conventional operating systems. Further, illustrated controller 132 may be adapted to execute any operating system, including Linux, UNIX, Windows, Mac OS, or any other suitable operating system.

Typically, the controller 132 includes a processor, an interface, a memory, and one or more software applications. The interface is used by the controller 132 for communicating with other systems in a client-server or other distributed environment (including within system 100) connected to a network. Generally, the interface comprises logic encoded in software and/or hardware in a suitable combination and operable to communicate with the network.

Alternatively (or additionally), the controller 132 may be a client device that includes an electronic computer device operable to receive, transmit, process, and store any appropriate data associated with the system 100. As used in this disclosure, "client" is intended to encompass a personal computer, touch screen terminal, workstation, network computer, kiosk, wireless data port, smart phone, personal data assistant (PDA), one or more processors within these or other devices, or any other suitable processing device. For example, each controller 132 may comprise a computer that includes an input device, such as a keypad, touch screen, mouse, or other device that can accept user information, and an output device that conveys information associated with the operation of the controller 132 or the controller 132 itself, including digital data or visual information. Both the input and output device may include fixed or removable storage media such as a magnetic storage media, CD-ROM, or other suitable media to both receive input from and provide output to users of the controller 132 through a display.

Figure 2A:
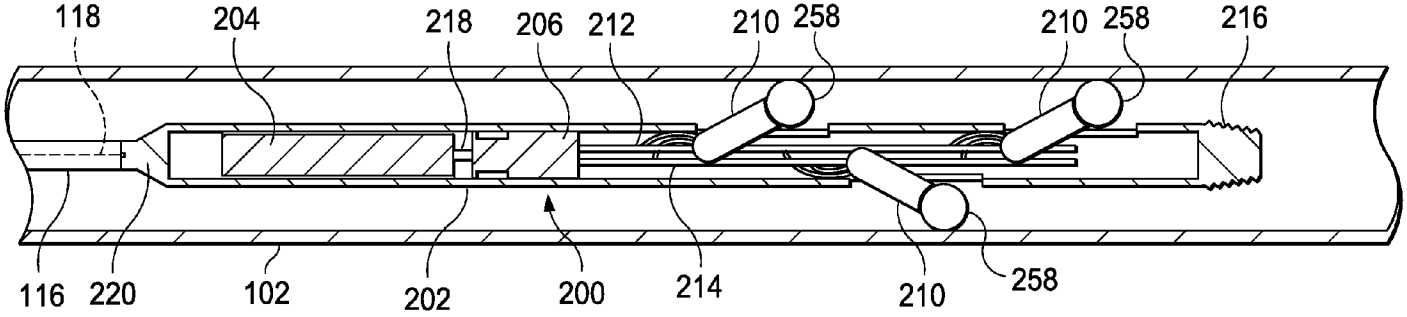
FIGS. 2A-2B illustrate example embodiments of a variable ratio downhole tractor.
Figure 2B:
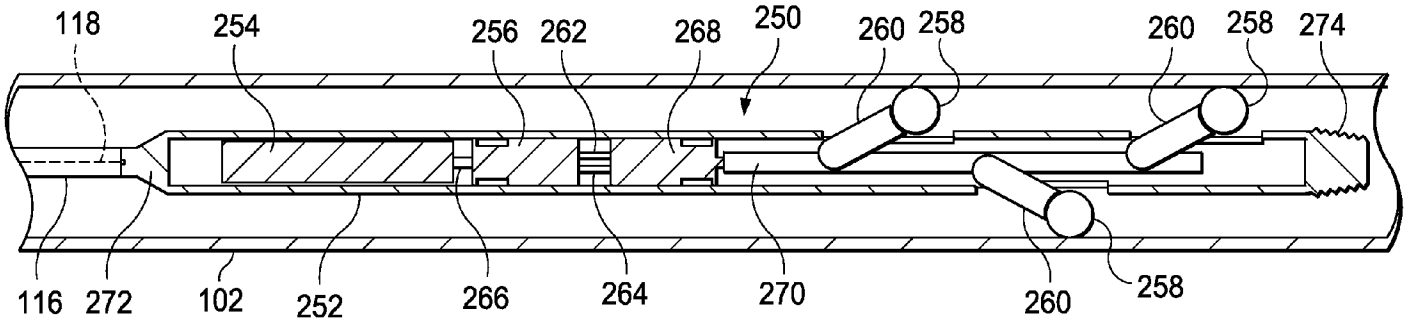

FIGS. 2A-2B illustrate example embodiments of a variable ratio downhole tractor. With reference to FIG. 2A, a variable ratio tractor 200 is illustrated within the wellbore 102 and coupled to the wireline 116 (at an uphole end of the variable ratio tractor 200). The illustrated variable ratio tractor 200 includes a housing 202 that encloses (at least partially) an electronics sub 220, an electric motor 204, a hydraulic pump 206, and one or more wheels 258 extendable from the housing to 202 to contact the wellbore 102 that are coupled to associated hydraulic motors 210 (mounted in pivotable arms, as shown).

The electric motor 204, in some embodiments, is a DC electric motor that receives power from, for example, the surface/control system 122, through the wireline 118 that is coupled to the variable ratio tractor 200 through the electronics sub 220. In some embodiments, the electric motor 204 may be chosen with a maximum motor power based on a required force or torque and tractor speed of the variable ratio tractor 200, in addition to a safety factor. For instance, the electric motor 204 may be selected so that at maximum current and voltage ratings, the voltage is at half of the maximum voltage allowed on the line and the current is the maximum that can be drawn through a wireline long enough to perform an extreme job at temperature. This allows maximum power transfer downhole when the electric motor 204 is running at full speed and full load.

The electric motor 204 is coupled to the hydraulic pump 206 by a shaft 218. The hydraulic pump 206, in some embodiments, is a variable displacement pump driven by the electric motor 204. As a variable displacement pump, the hydraulic pump 206 may operate with a particular fluid output per revolution that can be varied over a range. For example, while the power into the hydraulic pump 206 is limited by the electric motor 204, the pump 206 can operate with a maximum power output in a range bounded at one end by a high flow rate at a low pressure, or at another end by a low flow rate at a high pressure. In some embodiments, the fluid flow output and/or fluid pressure of the hydraulic pump 206 may be varied by varying an angle of a swash plate, which varies a stroke length of one or more pistons of the hydraulic pump 206.

In some embodiments, the hydraulic pump 206 swash plate may be controlled (e.g., by the surface/control system 122 or otherwise) based on pump output pressure or otherwise. For example, the swash plate may be coupled to a piston with a spring that has a hydraulic output of the pump 206 ported to it. As pressure goes up, the spring compresses and adjusts the swash plate in order to output less volume per revolution. As pressure goes down, the spring expands and adjusts the swash plate in order to output more volume per revolution. In some embodiments, the swash plate could be controlled externally as well, e.g., pressure may be relayed to the swash plate.

In some embodiments, the effect of the variable displacement hydraulic pump 206 may be to act as a variable speed transmission for the variable ratio tractor 200. The speed of the tractor 200 (e.g., during a tractoring run of the tractor 200 in the wellbore 102) can be varied by changing pump displacement. Thus, the variable ratio tractor 200 may, in essence, change gear ratios downhole to match the instant, real-time, or near real-time operating conditions.

For example, the gear ratio can be changed so that a constant power could be delivered to the tractor wheels 258. At the beginning of a horizontal section of the wellbore 102 (e.g., the horizontal portion 112) when the force necessary to run the wireline 116 through the wellbore 102 is low, the tractor 200 can be run at high speeds and low force. The displacement of the hydraulic pump 206 can be changed as the load increases so that at the end of the horizontal portion 112, the tractor 200 is traveling at a lower speed but can supply a higher force. Thus, the hydraulic pump 206 may allow the electric motor 254 to operate at a constant power across a range of loads, allowing the tractor 200 to control the power being delivered downhole.

In the illustrated variable ratio tractor 200, the hydraulic pump 206 is fluidly coupled to one or more of the hydraulic motors 210 with a supply conduit 212 and a return conduit 214. The conduits 212 and 214 enclose a working fluid that is pumped to the hydraulic motors 210 from the hydraulic pump 206. The working fluid is provided to one or more of the hydraulic motors 210 at a particular flow rate and fluid pressure. As the operational speed of the hydraulic pump 206 remains substantially constant, but the flow rate and/or fluid pressure is adjusted through adjustment of, e.g., the swash plate, then a speed of the variable ratio tractor 200 may be adjusted. In some embodiments, each wheel 258 is connected (e.g., through a gear train or otherwise) to a particular hydraulic motor 210 that is fluidly coupled to the hydraulic pump 206. Thus, in such embodiments, each hydraulic motor 210 may drive the wheel 258 coupled thereto at an adjustable speed.

In alternative embodiments, less than all of the wheels 258 may be coupled to a corresponding hydraulic motor 210. Wheels 258 that are not coupled to a hydraulic motor 210 may, therefore, freely spin while in contact with, for example, the wellbore 102 during a tractoring run of the variable ratio tractor 200. Thus, in some embodiments, only a portion of the wheels 258 coupled to the housing 202 may be driven by the hydraulic pump 206 through a corresponding hydraulic motor 210. For example, the hydraulic motor 210 may drive the wheels 258 through a gear train (not shown).

A downhole end of the variable ratio tractor 200 includes a coupling sub 216. The coupling sub 216 may be coupled to a downhole tool, such as, for example, a shifting tool, a logging tool, an explosive tool (e.g., a perforating gun or otherwise), a packer, or other type of downhole tool, or another segment of drill pipe or tubing. In some embodiments, the particular type of the downhole tool coupled to variable ratio tractor 200 may dictate an operational speed of the variable ratio tractor 200. For example, if the downhole tool coupled to the variable ratio tractor 200 is a perforating gun (or other explosive tool), the variable ratio tractor 200 may be controlled to operate based on the instantaneous wellbore conditions, i.e., speed of the variable ratio tractor 200 depends on the force acting against the variable ratio tractor 200 (e.g., weight of wireline 116 and friction in wellbore 102). As the length of the wireline 118 increases, speed of the variable ratio tractor 200 will decrease. As an alternative example, the variable ratio tractor 200 may be controlled (e.g., by the surface/control system 122 or otherwise) to operate at a substantially constant speed, such as when the downhole tool is a logging or measurement tool.

In operation, electric power (i.e., voltage and current) is applied to the electric motor 204 through the wireline 118. In some embodiments, the electric power may be substantially constant and applied at a maximum possible value from the surface/control system 122. The electric motor 204 drives the hydraulic pump 206 through the shaft 218. The hydraulic pump 206, in turn, circulates the working fluid to the hydraulic motors 210 through the supply and return conduits 212 and 214. The fluid flow rate and pressure may depend on the operating conditions of the variable ratio tractor 200 in the wellbore 102. For instance, as the variable ratio tractor 200 is traveling in the vertical portion 108 and radius 110, the variable ratio tractor 200 may travel at a maximum possible speed available at the electric power provided to the motor 204, because little or no force is required of the variable ratio tractor 200 to drag the wireline 116 and/or overcome wellbore friction (e.g., due to effect of gravity). Alternatively, in some embodiments, little or no power may be provided to the electric motor 204 while the tractor 200 is in a vertical portion 108 and/or radiussed portion 110 of the wellbore 102, as the surface winch system and gravity are sufficient for moving the tool downhole.

Further, as the variable ratio tractor 200 transitions from the radius 110 to the horizontal portion 112, speed may remain high because only low force may be required of the variable ratio tractor 200. However, as the variable ratio tractor 200 tractors further into the horizontal portion 112, drag of the wireline 116 increases, thereby requiring more force from the variable ratio tractor 200. As more force is necessary from the variable ratio tractor 200, speed will decrease given the same electric power supplied to the motor 254.

Increasing force required of the variable ratio tractor 200 may cause adjustment of the hydraulic pump 206, for example, the swash plate of the hydraulic pump 206 as described above. Adjustment of the swash plate adjusts the working fluid flow rate and/or fluid pressure circulated from the hydraulic pump 206 to one or more of the hydraulic motors 210. As the working fluid flow rate or pressure is adjusted, a rotational speed at which one or more of the wheels 258 are driven is adjusted.

Turning to FIG. 2B, a variable ratio tractor 250 is illustrated within the wellbore 102 and coupled to the wireline 116 (at an uphole end of the variable ratio tractor 250). The illustrated variable ratio tractor 250 includes a housing 252 that encloses (at least partially) an electronics sub 272, an electric motor 254, a hydraulic pump 256, and one or more wheels 258 extendable from the housing to 252 to contact the wellbore 102. The variable ratio tractor 250 also includes gear trains 260 enclosed in pivotable arms that are coupled to a shaft 270 coupled to a hydraulic motor 268.

The electric motor 254, may be substantially similar to the electric motor 204 described above. For example, in some embodiments, the electric motor 254 is a DC electric motor that receives power from, for example, the surface/control system 122, through the wireline 118 that is coupled to the variable ratio tractor 250 through the electronics sub 272. In some embodiments, the electric motor 254 may be chosen with a maximum motor power based on a required force or torque and tractor speed of the variable ratio tractor 250, in addition to a safety factor. For instance, the electric motor 254 may be selected so that at maximum current and voltage ratings, the voltage is at half of the maximum voltage allowed on the line and the current is the maximum that can be drawn through a wireline long enough to perform an extreme job at temperature. This allows maximum power transfer downhole when the electric motor 254 is running at full speed and full load.

The electric motor 254 is coupled to the hydraulic pump 256 by a shaft 266. The hydraulic pump 256, in some embodiments, is a variable displacement pump driven by the electric motor 254. As a variable displacement pump, the hydraulic pump 256 may operate with a particular fluid output per revolution that can be varied over a range. For example, while the power into the hydraulic pump 256 is limited by the electric motor 254, the pump 256 can operate with a maximum power output in a range bounded at one end by a high flow rate at a low pressure, or at another end by a low flow rate at a high pressure. In some embodiments, the fluid flow output and/or fluid pressure of the hydraulic pump 256 may be varied by varying an angle of a swash plate, which varies a stroke length of one or more pistons of the hydraulic pump 256. In some embodiments, the hydraulic pump 256 swash plate may be controlled (e.g., by the surface/control system 122 or otherwise) based on pump output pressure or otherwise.

In some embodiments, the effect of the variable displacement hydraulic pump 256 may be to act as a variable speed transmission for the variable ratio tractor 250. The speed (e.g., during a tractoring run of the tractor 250 in the wellbore 102) can be varied by changing pump displacement. Thus, the variable ratio tractor 250 may, in essence, change gear ratios downhole to match the instant, real-time, or near real-time operating conditions. For example, the gear ratio can be changed so that a constant power could be delivered to the tractor wheels 258. At the beginning of a horizontal section of the wellbore 102 (e.g., the horizontal portion 112) when the force necessary to run the wireline 116 through the wellbore 102 is low, the tractor 250 can be run at high speeds and low force. The displacement of the hydraulic pump 256 can be changed as the load increases so that at the end of the horizontal portion 112, the tractor 250 is traveling at a lower speed but can supply a higher force. Thus, the hydraulic pump 256 may allow the electric motor 254 to operate at a constant power across a range of loads, allowing the tractor 250 to control the power being delivered downhole.

In the illustrated variable ratio tractor 250, the hydraulic pump 256 is fluidly coupled to the hydraulic motor 268 through a supply conduit 262 and a return conduit 264. The conduits 262 and 264 enclose a working fluid that is pumped to the hydraulic motor 268 from the hydraulic pump 256. The working fluid is provided to the hydraulic motor 268 at a particular flow rate and fluid pressure. As the operational speed of the hydraulic pump 256 remains substantially constant, but the flow rate and/or fluid pressure is adjusted through adjustment of, e.g., the swash plate, then a speed of the variable ratio tractor 250 may be adjusted. As the flow rate and/or fluid pressure is adjusted, a rotational speed of the shaft 270 driven by the hydraulic motor 268 is adjusted as well, which adjusts the speed of the tractor 250.

In some embodiments, each wheel 258 is driven by the shaft 270 (e.g., through a gear train or otherwise). In alternative embodiments, less than all of the wheels 258 may be driven by the shaft 270. Wheels 258 that are not driven by the shaft 270 may, therefore, freely spin while in contact with, for example, the wellbore 102 during a tractoring run of the variable ratio tractor 250. Thus, in some embodiments, only a portion of the wheels 258 coupled to the housing 252 may be driven by the hydraulic pump 256 through the hydraulic motor 268.

A downhole end of the variable ratio tractor 250 includes a coupling sub 274. The coupling sub 274 may be coupled to a downhole tool, such as, for example, a shifting tool, a logging tool, an explosive tool (e.g., a perforating gun or otherwise), a packer, or other type of downhole tool, or other payload. In some embodiments, the particular type of the downhole tool coupled to variable ratio tractor 250 may dictate an operational speed of the variable ratio tractor 250. For example, if the downhole tool coupled to the variable ratio tractor 250 is a perforating gun (or other explosive tool), the variable ratio tractor 250 may be controlled to operate based on the instantaneous wellbore conditions, i.e., speed of the variable ratio tractor 250 depends on the force acting against the variable ratio tractor 250 (e.g., weight of wireline 116 and friction in wellbore 102). As the length of the pulled wireline 116 increases, speed of the variable ratio tractor 250 will decrease. As an alternative example, the variable ratio tractor 250 may be controlled (e.g., by the surface/control system 122 or otherwise) to operate at a substantially constant speed, such as when the downhole tool is a logging or measurement tool.

In operation, electric power (i.e., voltage and current) is applied to the electric motor 254 through the wireline 118. In some embodiments, the electric power may be substantially constant and applied at a maximum possible value from the surface/control system 122. The electric motor 254 drives the hydraulic pump 256 through the shaft 266. The hydraulic pump 256, in turn, circulates the working fluid to the hydraulic motor 268 through the supply and return conduits 262 and 264. The fluid flow rate and pressure may depend on the operating conditions of the variable ratio tractor 250 in the wellbore 102. For instance, as the variable ratio tractor 250 is traveling in the vertical portion 108 and radius 110, the variable ratio tractor 250 may travel at a maximum possible speed available at the electric power provided to the motor 254, because little or no force is required of the variable ratio tractor 250 to drag the wireline 116 and/or overcome wellbore friction (e.g., due to effect of gravity). Alternatively, in some embodiments, little or no power may be provided to the electric motor 254 while the tractor 250 is in a vertical portion 108 and/or radiussed portion 110 of the wellbore 102.

Further, as the variable ratio tractor 250 transitions from the radius 110 to the horizontal portion 112, speed may remain high because only low force may be required of the variable ratio tractor 250. However, as the variable ratio tractor 250 tractors further into the horizontal portion 112, weight of the wireline 116 increases, thereby requiring more force from the variable ratio tractor 250. As more force is necessary from the variable ratio tractor 250, speed will decrease given the same electric power supplied to the motor 254.

Increasing force required of the variable ratio tractor 250 may cause adjustment of the hydraulic pump 256, for example, the swash plate of the hydraulic pump 256 as described above. Adjustment of the swash plate adjusts the working fluid flow rate and/or fluid pressure circulated from the hydraulic pump 256 to the hydraulic motor 268. As the working fluid flow rate or pressure is adjusted, a rotational speed at which one or more of the wheels 258 are driven is adjusted. In some embodiments, the hydraulic motor 268 may also have an adjustable revolution per volume output, further extending the effective gear ratio range of the variable ratio tractor 250.

Figure 3A:
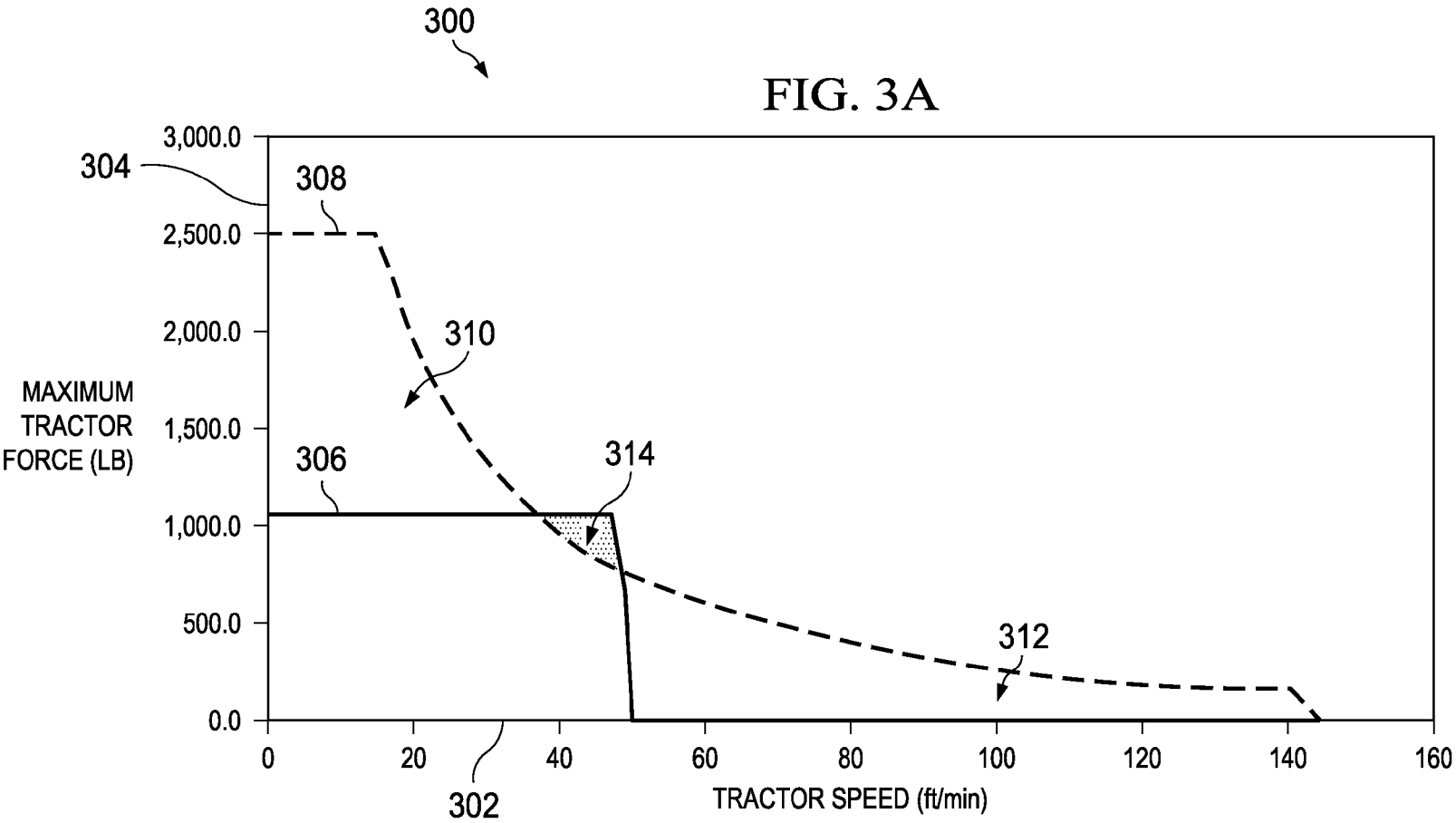
FIG. 3A-3B illustrate graphs showing performance aspects of an example variable ratio downhole tractor.
Figure 3B:
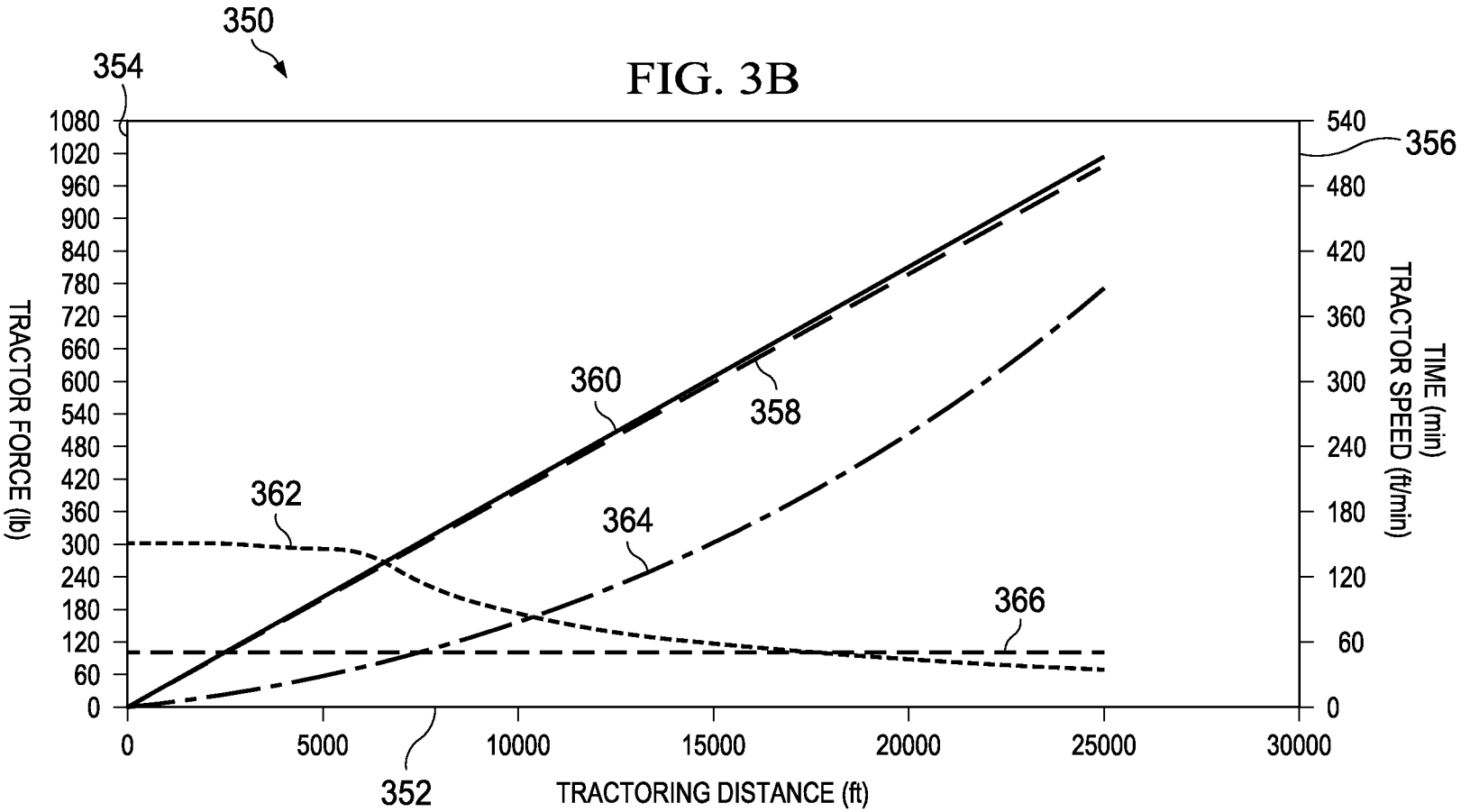

FIG. 3A-3B illustrate graphs 300 and 350, respectively, showing performance aspects of an example variable ratio downhole tractor. Turning to FIG. 3A, graph 300 includes a tractor speed axis (ft./min) 302 and a tractor force axis (lbs.) 304. As illustrated, graph 300 shows an estimated tractor performance of a fixed gear ratio tractor ("fixed ratio tractor") having a 2.52 kW electric motor and an estimated tractor performance of a variable gear ratio tractor ("variable ratio tractor") also having a 2.52 kW electric motor. Thus, graph 300 may compare the fixed ratio and variable ratio tractors having the same maximum available electrical power input. The electric motors of the fixed ratio tractor and variable ratio tractor are assumed to be identical in graph 300 and each is a DC motor that has maximum voltage and maximum current performance limits. Such limits will determine the maximum RPM and maximum continuous force of the electric motor. The motor speed is proportional to the voltage, and the force is proportional to the current. Exceeding the continuous current rating of the motor for very long will cause the motor to overheat and lead to catastrophic failure.

The DC motors of the fixed ratio tractor and variable ratio tractor are selected so that at maximum current and voltage ratings, the voltage is at half of the maximum voltage allowed on the line and the current is the maximum that can be drawn through a line long enough to perform an extreme job at temperature. This allows maximum power transfer downhole when the motor is running at full speed and full load.

The force that a tractor needs to pull at any point in the wellbore is dependent on downhole conditions. In a long horizontal section of the wellbore, the maximum force will be at the far end, because the tractor is required to pull the longest length of wireline (or, in some embodiments, coiled tubing) at that point. For example, typically, the required tractor force in a straight horizontal section will build linearly from zero when the tractor starts to the maximum value at the far end of the horizontal section. In the fixed gear ratio tractor, the motor current will be proportional to the tractor force, so maximum power can only be reached when the tractor can't pull any harder. The downhole conditions determine the motor current and may not be controlled in the fixed gear ratio tractor. The motor voltage determines the speed and can be controlled. Since the electrical power is the current times the voltage and voltage can be controlled, the downhole power being delivered by the fixed ratio tractor may not be entirely controllable.

In contrast, and as described above, the effective gear ratio of the variable ratio tractor can be changed so that a constant power could be delivered to the tractor wheels. Thus, at the beginning of the horizontal section when the force is low, the variable ratio tractor can be run at high speeds and low force. As the load increases (e.g., at the end of the horizontal section) the variable ratio tractor may travel at a lower speed but can supply a higher force.

As illustrated, the fixed ratio tractor is designed for a maximum tractor force of about 1,000 lbs. as shown by the force-speed curve 306. The force-speed curve 306 shows that between 0 and 1,000 lbs. tractor force, the speed of the fixed ratio tractor is substantially constant around 50 ft./min. Thus, from an operating condition in which the fixed ratio tractor is generating almost no force (e.g., at the beginning of a horizontal portion of the wellbore) to an operating condition in which the fixed ratio tractor is generating about 1,000 lbs. (e.g., the design point when the tractor is at an end of the horizontal portion), the tractor speed varies only a little (e.g., about 3-5 feet/min).

In comparison, the variable ratio tractor can achieve a greater possible tractor force while also achieving a greater maximum speed relative to the fixed ratio tractor. For example, a force-speed curve 308 illustrates the possible operating conditions of the variable ratio tractor. As illustrated by the force-speed curve 308, the variable ratio tractor can achieve a maximum tractor speed of about 150 feet/min when generating almost no force (e.g., at the beginning of a horizontal portion of the wellbore). Further, the variable ratio tractor can achieve a maximum tractor force of about 2,500 lbs. at a low speed (e.g., between 0 and 15 feet/min). At a design point of 1,000 lbs. required tractor force, the force-speed curve 308 illustrates that the variable ratio tractor achieves a speed of about 38 feet/min.

As illustrated, although the fixed ratio tractor achieves a greater speed when the tractor force is between about 750 lbs. and 1,000 lbs., the variable ratio tractor achieves a greater speed between 0 and 750 lbs. tractor force, while also having a higher possible maximum tractor force. Further, as illustrated in the graph 300, the variable ratio tractor is more efficient than the fixed ratio tractor in areas 310 and 312 of the graph 300 (e.g., where the force-curve 308 is higher than the force-curve 306). For example, the fixed ratio tractor may only be more efficient in the shaded area 314 which is bounded at a maximum tractor force 306 of about 1,000 lbs. and at a tractor speed of about 50 ft./sec at the maximum tractor force 306.

In the illustrated graph 300, overall tractor efficiencies of the fixed ratio tractor and variable ratio tractor may be different even though the motor efficiencies are identical between the two tractors. For example, the motor efficiency may be about equal, but the fixed ratio tractor may have an overall maximum efficiency (e.g., mechanical power output divided by available electric power input) of between about 0.40 and 0.45, while the variable ratio tractor may have an overall maximum efficiency (e.g., mechanical power output divided by available electric power input) of about 0.35 (e.g., due to additional component(s) such as a variable displacement hydraulic pump). Thus, even though the variable ratio tractor may have a lower overall maximum efficiency, it still may have more efficient operation over about 75% of the operating conditions as compared to the fixed ratio tractor.

Turning to FIG. 3B, graph 350 includes a tractoring distance axis (ft.) 352, a tractor force axis (lbs.) 354, and a time-speed axis (min-ft./min) 356. As illustrated, graph 350 shows an estimated tractor performance of a fixed gear ratio tractor ("fixed ratio tractor") having a 2.52 kW electric motor and an estimated tractor performance of a variable gear ratio tractor ("variable ratio tractor") also having a 2.52 kW electric motor. Thus, graph 350 may compare the fixed ratio and variable ratio tractors having the same maximum electrical power input.

The illustrated graph 350 includes five curves. Curve 358 illustrates a design curve having a particular linear relationship between tractor force and tractoring distance (e.g., from a beginning point of a horizontal portion of a wellbore) between 0 ft. and 25,000 ft. tractoring distance. Curve 360 illustrates an elapsed time curve of the fixed ratio tractor between 0 ft. and 25,000 ft. tractoring distance. Because the fixed ratio tractor is designed for the maximum tractor force required at a maximum tractoring distance, the curve 360 is substantially similar to the curve 358. As illustrated, the elapsed time for the fixed ratio tractor to reach the design tractoring distance of 25,000 ft. is about 510 minutes.

Curve 362 illustrates a speed curve of the variable ratio tractor illustrating that the speed of the variable ratio tractor varies from about 150 ft./min between about 0 and 6000 ft. tractoring distance to about 30 ft./min at 25,000 ft. tractoring distance. Curve 366 illustrates a speed curve of the fixed ratio tractor illustrating that the speed of the fixed ratio tractor is substantially constant at about 50 ft./min.

Curve 364 illustrates an elapsed time curve of the variable ratio tractor between 0 ft. and 25,000 ft. tractoring distance. Because the variable ratio tractor includes a variable speed transmission that can adjust a speed and tractoring force of the variable ratio tractor based on a drag on the tractor (e.g., based on the weight of the coiled tubing or wireline pulled by the tractor and other wellbore conditions), the curve 364 does not reflect a linear relationship between tractor force and tractoring distance but instead reflects a non-linear relationship. As illustrated, the elapsed time for the variable ratio tractor to reach the design tractoring distance of 25,000 ft. is about 390 minutes.

As illustrated in graph 350, although the fixed ratio tractor has a higher speed at the maximum tractoring distance (about 50 ft./min vs. about 30 ft./min), the variable ratio tractor has a much lower elapsed tractoring time, thereby completing the tractoring job more efficiently than the fixed ratio tractor. In some aspects, this occurs even when a maximum tractor efficiency of the fixed ratio tractor (e.g., about 0.40 to 0.45) is greater than a maximum tractor efficiency of the variable ratio tractor (e.g., about 0.35) at the same or similar design condition. In some embodiments, the variable ratio tractor may have an equal or higher maximum tractor efficiency as compared to the fixed ratio tractor. In such embodiments, the variable ratio tractor may overall be even more efficient (e.g., complete the tractoring run in less time) than the fixed ratio tractor.

Figure 4A:
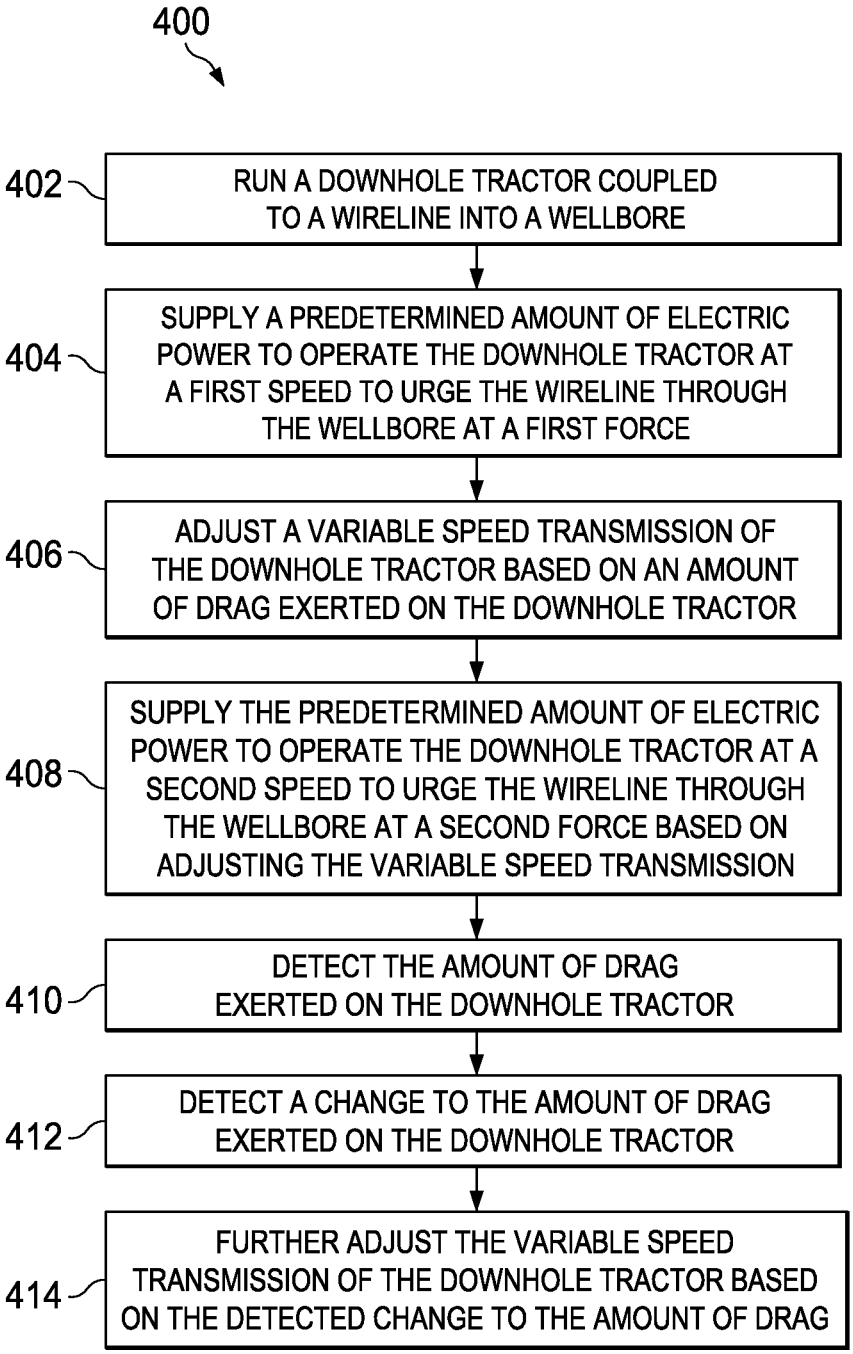
FIGS. 4A-4C illustrate example methods of operation of a variable ratio downhole tractor.
Figure 4B:
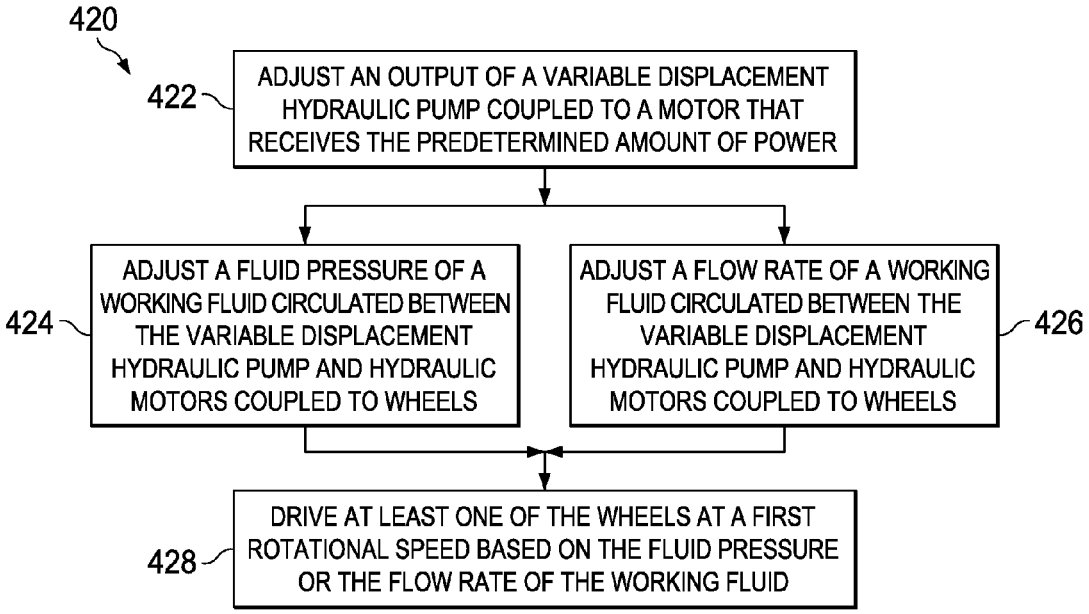
Figure 4C:
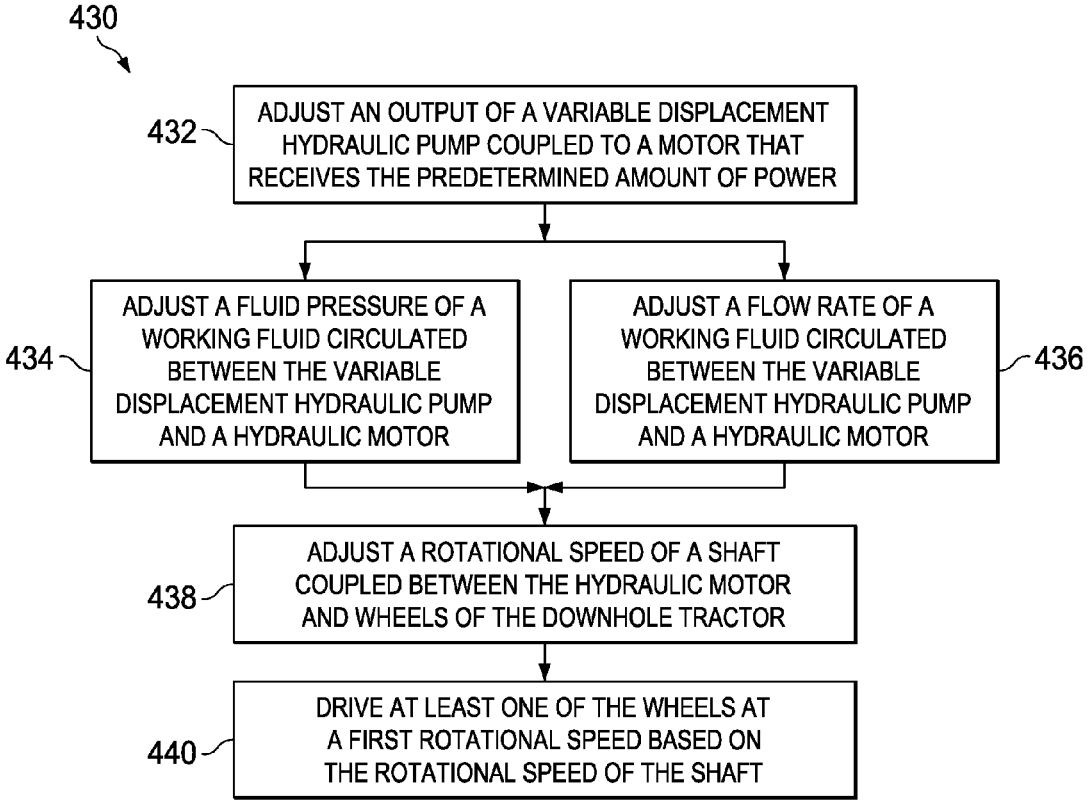

FIGS. 4A-4C illustrate example methods of operation of a variable ratio downhole tractor. In some implementations of methods 400, 420, and 430, a variable ratio tractor may be used to implement the particular method, such as the variable ratio tractor 200 or the variable ratio tractor 250. In other implementations, a variable ratio tractor in accordance with the present disclosure other than the variable ratio tractor 200 and variable ratio tractor 250 may be used.

Turning to FIG. 4A, method 400 is illustrated. Method 400 may begin at step 402, when a downhole tractor (e.g., a variable ratio tractor) that is coupled to a wireline is run into a wellbore. At step 404, a predetermined amount of electric power is supplied to the downhole tractor to urge the downhole tractor and the wireline through the wellbore at a first speed and a first force. In some implementations, electric power may be supplied to the downhole tractor as the downhole tractor enters a radius or a horizontal portion of an articulated wellbore. In some implementations, the electric power may be supplied to the downhole tractor through a length of the articulated wellbore (e.g., through a vertical portion, radius, and horizontal portion).

In step 406, a variable speed transmission of the downhole tractor may be adjusted based on an amount of drag exerted on the downhole tractor. In some embodiments, the variable speed transmission of the downhole tractor may consist of one or more components including a variable displacement hydraulic pump operable to circulate a working fluid at a variable flow rate and pressure to one or more hydraulic motors. In some embodiments, the variable speed transmission may be coupled between an electric motor and one or more wheels of the downhole tractor and be operable to receive a substantially constant mechanical power from the electric motor (e.g., through a shaft coupled between the motor and the variable displacement pump) and supply a variable rotational power to the wheels.

In step 408, the predetermined amount of electric power (e.g., a constant power) is supplied to the downhole tractor to urge the downhole tractor and the wireline through the wellbore at a second speed and a second force based on adjusting the variable ratio tractor. The second speed is less than the first speed and the second force is greater than the first force. Of course, steps 406 and 408 may be repeated multiple times during a tractoring run of the variable ratio tractor, as wellbore conditions and force applied against the variable ratio tractor (e.g., from friction, weight of a coiled tubing or weight of the wireline) changes. Further, in some implementations, the first speed may be slower than the second speed while the first force is greater than the second force. Thus, the variable ratio tractor can then be adjusted to a higher speed/lower force operating state until the tractor is using the maximum electrical power.

In step 410, an amount of drag (e.g., force associated with the weight of the coiled tubing or wireline plus friction of the wellbore) exerted on the downhole tractor is detected. For example, one or more sensors in the downhole tractor may detect the force and transmit the detected force to, for instance, a control system such as the surface/control system 122. In another embodiment, the detected force may be determined (e.g., by the control system) based on an instant speed and/or force of the downhole tractor.

In step 412, a change to the amount of drag (e.g., force associated with the weight of the coiled tubing or wireline plus friction of the wellbore) exerted on the downhole tractor is detected. For instance, in some embodiments, measurements of the drag on the downhole tractor may be taken over a predetermined time duration and compared in order to determine the change to the amount of drag.

In step 414, the variable speed transmission of the downhole tractor may be further adjusted based on the detected change to the amount of drag exerted on the downhole tractor. As described in step 406, the variable speed transmission of the downhole tractor may consist of one or more components including a variable displacement hydraulic pump operable to circulate a working fluid at a variable flow rate and pressure to one or more hydraulic motors. In some embodiments, the variable speed transmission may be coupled between the electric motor and one or more wheels of the downhole tractor and be operable to receive a substantially constant mechanical power from the electric motor (e.g., through a shaft coupled between the motor and the variable displacement pump) and supply a variable rotational power to the wheels.

Turning to FIG. 4B, method 420 is illustrated. In some implementations, method 420 may include one or more steps for adjusting a speed of a variable ratio transmission in accordance with step 406 above. For example, method 420 may be implemented by the variable ratio tractor 200 described above. For instance, method 420 may be implemented with a variable ratio transmission that includes an electric motor (e.g., motor 204) coupled to a variable displacement pump (e.g., pump 206) that supplied a working fluid to hydraulic motors (e.g., hydraulic motors 210) coupled to wheels (e.g., wheels 258).

Method 420 may begin at step 422, when an output (e.g. fluid flow rate) of a variable displacement hydraulic pump of the downhole tractor is adjusted. The variable displacement hydraulic pump, in this implementation, is coupled to an electric motor that receives a predetermined amount (e.g., substantially constant) of electric power, for example, from a wireline. In some embodiments, the output of the variable displacement pump may be adjusted by adjusting a swash plate. In turn, adjustment of the swash plate may adjust a stroke length of a piston of the pump, thereby adjusting the volume displaced per revolution (or flow rate at constant RPM) of the pump.

Adjustment of the output of the variable displacement pump may include adjusting a fluid pressure of the working fluid circulated between the variable displacement pump and the hydraulic motors of the downhole tractor, as shown in step 424. Alternatively (or additionally), adjustment of the output of the variable displacement pump may include adjusting a fluid flow rate of the working fluid circulated between the variable displacement pump and the hydraulic motors of the downhole tractor, as shown in step 426.

In step 428, at least one of the wheels of the downhole tractor may be driven at a particular rotational speed (e.g., a rotational speed that is operable to propel the downhole tractor through the wellbore at the second speed as in step 408) based on the adjusted fluid flow rate and/or fluid pressure. Steps 422 through 428 may be repeated, as necessary, based on variable conditions in the wellbore and/or increasing or decreasing drag (e.g., force) exerted on the downhole tractor during a tractoring run.

Turning to FIG. 4C, method 430 is illustrated. In some implementations, method 430 may include one or more steps for adjusting a speed of a variable ratio transmission in accordance with step 406 above. For example, method 430 may be implemented by the variable ratio tractor 250 described above. For instance, method 430 may be implemented with a variable ratio transmission that includes an electric motor (e.g., motor 254) coupled to a variable displacement pump (e.g., pump 256) that supplied a working fluid to a hydraulic motor (e.g., hydraulic motor 268) coupled to wheels (e.g., wheels 258).

Method 430 may begin at step 432, when an output of a variable displacement hydraulic pump of the downhole tractor is adjusted. The variable displacement hydraulic pump, in this implementation, is coupled to an electric motor that receives a predetermined amount (e.g., substantially constant) of electric power, for example, from a wireline. In some embodiments, the variable displacement pump may be adjusted by adjusting a swash plate. In turn, adjustment of the swash plate may adjust a stroke length of a piston of the pump, thereby adjusting the volume displaced per revolution (or flow rate at constant RPM) of the pump.

Adjustment of the output of the variable displacement pump may include adjusting a fluid pressure of the working fluid circulated between the variable displacement pump and the hydraulic motor of the downhole tractor, as shown in step 434. Alternatively (or additionally), adjustment of the output of the variable displacement pump may include adjusting a fluid flow rate of the working fluid circulated between the variable displacement pump and the hydraulic motor of the downhole tractor, as shown in step 436.

In step 438, a rotational speed of a shaft coupled between the hydraulic motor and at least one of the wheels is adjusted based on the adjusted fluid pressure and/or fluid flow rate.

In step 440, at least one of the wheels of the downhole tractor may be driven at a particular rotational speed (e.g., a rotational speed that is operable to propel the downhole tractor through the wellbore at the second speed as in step 408) based on the adjusted rotational speed of the shaft coupled between the wheel(s) and hydraulic motor. Steps 432 through 440 may be repeated, as necessary, based on variable conditions in the wellbore and/or increasing or decreasing drag (e.g., force) exerted on the downhole tractor during a tractoring run.

A number of embodiments have been described. Nevertheless, it will be understood that various modifications may be made. For example, other methods described herein besides or in addition to that illustrated in FIGS. 4A-4C may be performed. Further, the illustrated steps of methods 400, 420, and 430 may be performed in different orders, either concurrently or serially. Further, steps may be performed in addition to those illustrated in methods 400, 420, and 430, and some steps illustrated in methods 400, 420, and 430 may be omitted without deviating from the present disclosure. As another example, although some embodiment herein have been described as utilizing a wireline, alternative embodiments of a variable ratio tractor may be coupled to a coiled tubing that extends to the terranean surface.

Further, although some embodiments have been described as utilizing a hydraulic system, other forms of variable ratio tractors are within the scope of the present disclosure. For example, a variable ratio tractor that utilizes a constantly variable transmission using, e.g., adjustable pulley diameters, is also within the scope of the present disclosure. Further, although some electric motors described herein have been described as DC motors, AC motors may be used in place of DC motors where appropriate. Further, although some embodiments of a variable ratio tractor have been described as having a variable displacement pump in combination with a fixed displacement motor, alternative embodiments may include a fixed displacement pump in combination with a variable displacement motor without departing from the scope of this disclosure. As another example, some embodiments of a variable ratio tractor may utilize an "inchworm" drive rather than wheels to travel in the wellbore. The inchworm drive system is an electric motor driving a hydraulic pump, which in turn drives arms that open against the wellbore. A piston extends a section of the inchworm drive variable ratio tractor and a second set of arms on the extended section engages the wellbore. The piston retracts, pulling the first section along with it, and this repeats to move the tractor through the well. Accordingly, other embodiments are within the scope of the following claims.

What is claimed is:

1. A method, comprising:

running a well tractor coupled to a wireline into a wellbore;

supplying an amount of electric power to the well tractor to operate the well tractor at a first speed to urge the wireline through the wellbore at a first force;

adjusting a torque of a variable hydraulic gear ratio transmission of the well tractor; and supplying the amount of electric power to the well tractor to operate the well tractor at a second speed different than the first speed to urge the wireline through the wellbore at a second force different than the first force based on adjusting the variable ratio gear transmission.

2. The method of claim 1, wherein adjusting the torque of a variable hydraulic gear ratio transmission of the well tractor comprises adjusting the torque of the variable hydraulic gear ratio transmission of the well tractor based on an amount of drag on the tractor.

3. The method of claim 2, further comprising:

further adjusting the torque of the variable hydraulic gear ratio transmission of the well tractor based on the amount of drag exerted on the well tractor; and supplying the amount of electric power to the well tractor to operate the well tractor at a third speed less than the first and second speeds to urge the wireline through the wellbore at a third force greater than the first and second forces based on further adjusting the torque of the variable hydraulic gear ratio transmission.

4. The method of claim 2, further comprising:

further adjusting the torque of the variable hydraulic gear ratio transmission of the well tractor based on the amount of drag exerted on the well tractor; and supplying the amount of electric power to the well tractor to operate the well tractor at a third speed greater than the first and second speeds to urge the wireline through the wellbore at a third force less than the first and second forces based on further adjusting the torque of the variable hydraulic gear ratio transmission.

5. The method of claim 2, further comprising:

detecting the amount of drag exerted on the well tractor;

detecting a change to the amount of drag exerted on the well tractor; and further adjusting the torque of the variable hydraulic gear ratio transmission of the well tractor based on the detected change to the amount of drag exerted on the well tractor.

6. The method of claim 1, wherein adjusting the torque of the variable hydraulic gear ratio transmission of the well tractor comprises:

adjusting an output of a variable displacement hydraulic pump coupled to a motor that receives the amount of power; and based on the output adjustment of the variable displacement hydraulic pump, adjusting at least one of a fluid pressure or a flow rate of a working fluid circulated between the variable displacement hydraulic pump and a hydraulic motor coupled to a roller of the well tractor.

7. The method of claim 6, wherein adjusting the torque of the variable displacement hydraulic pump comprises adjusting a stroke length of a piston of the variable displacement hydraulic pump.

8. The method of claim 7, wherein adjusting the stroke length of a piston of the variable displacement hydraulic pump comprises adjusting a swash plate of the variable displacement hydraulic pump.

9. The method of claim 1, wherein supplying the amount of electric power to the well tractor comprises supplying an amount of electric power to an electric motor of the well tractor that is coupled to the variable hydraulic gear ratio transmission through a shaft to drive the shaft at a substantially constant rotational speed.

10. The method of claim 1, wherein adjusting the torque of the variable hydraulic gear ratio transmission of the well tractor comprises:

adjusting an output of a variable displacement hydraulic pump coupled to a motor that receives the amount of power;

based on the output adjustment of the variable displacement hydraulic pump, adjusting at least one of a fluid pressure or a flow rate of a working fluid circulated between the variable displacement hydraulic pump and a hydraulic motor; and adjusting a rotational speed of a shaft coupled between the hydraulic motor and a roller of the well tractor based on the adjustment of the fluid pressure or flow rate of the working fluid.

11. The method of claim 10, wherein adjusting the torque of the variable displacement hydraulic pump comprises adjusting a stroke length of a piston of the variable displacement hydraulic pump.

12. The method of claim 11, wherein adjusting the stroke length of a piston of the variable displacement hydraulic pump comprises adjusting a swash plate of the variable displacement hydraulic pump.

13. The method of claim 10, further comprising:

driving the roller at a first rotational speed based on the rotational speed of the shaft to operate the well tractor at the second speed.

14. The method of claim 10, wherein supplying an amount of electric power to the well tractor comprises supplying an amount of electric power to an electric motor of the well tractor that is coupled to the variable hydraulic gear ratio transmission through a main shaft to drive the main shaft at a substantially constant rotational speed.

15. A method comprising:

receiving an amount of electrical power at an electric motor of a well tractor;

outputting a first amount of force by the well tractor;

adjusting a torque of a variable hydraulic gear ratio transmission of the well tractor;

receiving the amount of electrical power at the electric motor of the well tractor; and outputting a second amount of force by the well tractor that is different than the first amount of force.

16. The method of claim 15, further comprising:

receiving a first amount of drag on the well tractor;

adjusting the torque of the variable hydraulic gear ratio transmission of the well tractor based on the first amount of drag;

receiving a second amount of drag on the well tractor that is different than the first amount of drag; and further adjusting the torque of the variable hydraulic gear ratio transmission of the well tractor based on the second amount of drag.

17. The method of claim 15, wherein adjusting a torque of a variable hydraulic gear ratio transmission of the well tractor comprises adjusting an output of a variable displacement hydraulic pump of the variable ratio transmission.

18. The method of claim 17, wherein adjusting the output of the variable displacement hydraulic pump of the variable hydraulic gear ratio transmission comprises adjusting a fluid flow rate or pressure of a working fluid circulated between the variable displacement hydraulic pump and a hydraulic motor.

19. The method of claim 18, further comprising:

adjusting a speed of a roller of the well tractor coupled to the hydraulic motor based on the adjusted flow rate or pressure of the working fluid.

* * * * *